US007219635B2

(12) United States Patent
Watabe et al.

(10) Patent No.: US 7,219,635 B2
(45) Date of Patent: May 22, 2007

(54) FOUR-CYCLE ENGINE AND SYSTEM FOR DETECTING PHASE DIFFERENCE OF FOUR-CYCLE ENGINE

(75) Inventors: Satoru Watabe, Akashi (JP); Toshio Araki, Kakogawa (JP); Keiji Takahashi, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/274,058

(22) Filed: Nov. 14, 2005

(65) Prior Publication Data

US 2006/0096563 A1 May 11, 2006

(30) Foreign Application Priority Data

Nov. 11, 2004 (JP) ..... 2004-327315

(51) Int. Cl.
*F01L 1/34* (2006.01)

(52) U.S. Cl. ..... 123/90.15; 123/90.17

(58) Field of Classification Search ..... 123/90.15, 123/90.16, 90.17, 90.18, 90.27, 90.31
See application file for complete search history.

(56) References Cited

U.S. PATENT DOCUMENTS 5,522,352 A * 6/1996 Adachi et al. ..... 123/90.15
6,684,830 B2 * 2/2004 Miyashita ..... 123/90.15
6,955,145 B1 * 10/2005 McCabe et al. ..... 123/90.15

FOREIGN PATENT DOCUMENTS

JP HEI 11-129963 5/1999
JP HEI 11-201011 7/1999

* cited by examiner

*Primary Examiner*—Ching Chang
(74) *Attorney, Agent, or Firm*—Alleman Hall McCoy Russell & Tuttle LLP

(57) ABSTRACT

A four-cycle engine typically including a crankshaft provided with a first gear, a camshaft provided with a second gear, an endless rotation transmission that is installed around the first and second gears and is configured to transmit rotation of the crankshaft to the camshaft, a crank phase detecting device configured to detect a rotational phase of the crankshaft that is obtained by dividing a phase corresponding to one rotation of the crankshaft by a number that is equal to or more than a half of teeth of the second gear of the camshaft, and a cam phase detecting device configured to detect at least one rotational phase of the camshaft.

13 Claims, 10 Drawing Sheets

FOUR-CYCLE ENGINE AND SYSTEM FOR DETECTING PHASE DIFFERENCE OF FOUR-CYCLE ENGINE

TECHNICAL FIELD

The present invention generally relates to a four-cycle engine, and particularly to a four-cycle engine configured to detect a phase difference between a crankshaft and a camshaft. The present invention also relates to a system for detecting the phase difference between the crankshaft and the camshaft in the four-cycle engine.

BACKGROUND

In general, four-cycle engines are classified into various types according to structures of valve systems. Personal watercraft or small vehicles are typically equipped with engines constructed in such a manner that camshafts are mounted above cylinders. Such engines are referred to as single overhead camshaft (SOHC) engines, which include a single camshaft, and double overhead camshaft (DOHC) engines, which include two camshafts.

In the SOHC type engine and the DOHC type engine, a crankshaft is coupled to camshaft(s) through a timing chain or a timing belt so that rotation of the crankshaft is transmitted to the camshaft(s). More specifically, the timing chain (or timing belt) is installed around a crank sprocket (or crank pulley) mounted on an end portion of the crankshaft, and a cam sprocket (or cam pulley) mounted on an end portion of the camshaft. Since the cam sprocket has twice as many teeth as those of the crank sprocket, the rotation of the crankshaft is transmitted to the camshaft such that the number of rotations of the camshaft becomes half as many as that of the crankshaft.

During assembly of the engine, first, the crankshaft provided with the crank sprocket is accommodated into a crankcase, and the camshaft provided with the cam sprocket is accommodated into a cylinder head. Then, the timing chain is installed around the crank sprocket and the cam sprocket, and a tensioner is caused to come into contact with the timing chain to apply a suitable tension to the timing chain. The cam pulley and the timing belt are incorporated into the engine according to a similar procedure.

The crankshaft rotates in cooperation with reciprocation of a piston coupled to the crankshaft through a connecting rod, while an intake valve and an exhaust valve operate in association with the rotation of the camshaft(s), causing an intake port and an exhaust port to open and close. In the four-cycle engine, the reciprocation of the piston is transmitted to the intake and exhaust valves through the crankshaft and the camshaft so that the piston and the intake and exhaust valves operate in association with each other.

It is necessary that the piston and the intake and exhaust valves operate in association with each other at suitable timings. More specifically, it is necessary that the intake and exhaust valves operate to open or close at timings at which the reciprocating piston is in a predetermined position. By allowing the piston and the intake and exhaust valves to suitably operate in association with each other, strokes (intake, compression, expansion, and exhaust strokes) in the interior of a combustion chamber are carried out correctly. As a result, high engine performance is obtained. Therefore, during assembly of the engine, it is necessary to incorporate a crankshaft and camshaft(s) with a correct phase difference (phase angle) between them.

However, since the timing chain is installed around the crank sprocket and the cam sprocket and then the tensioner is incorporated during assembly of the engine as described above, relative positions of the crankshaft and the camshaft may deviate from desired positions, that is, a phase difference between them may vary from a correct value, by application of the tension from the tensioner to the timing chain. As a result, engine performance may be degraded.

Japanese Laid-Open Patent Application Publication No. Hei. 11-129963 and No. Hei. 11-201011 disclose an engine equipped with a sensor configured to detect protrusions of a pulser rotor mounted on a crankshaft or a camshaft in order to detect which of the strokes the engine is traveling, and to thereby set suitable ignition timings.

In such an engine, it is possible to detect the phase difference between the crankshaft and the camshaft by using the pulser rotor and the sensor. But, the detecting precision is low because they are intended to detect which of the strokes the engine is traveling as described above. If the phase difference between the crankshaft and the camshaft is one tooth of the cam sprocket, it may be undetectable.

SUMMARY OF THE INVENTION

The present invention addresses the above described conditions, and an object of the present invention is to provide a four-cycle engine that is capable of detecting phase difference between a crankshaft and a camshaft with relatively high accuracy, and a system for detecting the phase difference of the four-cycle engine.

According to one aspect of the present invention, there is provided a four-cycle engine comprising a crankshaft provided with a first gear; a camshaft provided with a second gear; an endless rotation transmission that is installed around the first and second gears and is configured to transmit rotation of the crankshaft to the camshaft; a crank phase detecting device configured to detect a rotational phase of the crankshaft that is obtained by dividing a phase corresponding to one rotation of the crankshaft by a number that is equal to or more than a half of teeth of the second gear of the camshaft; and a cam phase detecting device configured to detect at least one rotational phase of the camshaft.

In such a configuration, the phase difference between the crankshaft and the camshaft is detected with high accuracy based on a signal detected by the crank phase detecting device and a signal detected by the cam phase detecting device. Since the crank phase detecting device is configured to detect the rotational phase of the crankshaft that is obtained by dividing a phase corresponding to one rotation of the crankshaft by a number that is equal to or more than a half of the teeth of the second gear of the camshaft, and the camshaft typically rotates once while the crankshaft rotates twice, the crank phase detecting device is capable of detecting the phase difference of one tooth of the second gear of the camshaft. The phase difference is detected in such a manner that a computing device may be communicatively coupled to the engine and may analyze the signal from the crank phase detecting device and the signal from the cam phase detecting device.

The crank phase detecting device may include a pulser rotor provided at a peripheral region thereof with a plurality of protrusions arranged in a circumferential direction thereof and a crank angle sensor configured to detect the protrusions, and the protrusions of the pulser rotor may be arranged at a predetermined pitch angle that is equal to or less than twice as large as a pitch angle of the teeth of the second gear of the camshaft.

The crank phase detecting device is easily configured by using the pulser rotor and the crank angle sensor. By arranging the protrusions at the peripheral region of the pulser rotor at the predetermined pitch angle that is equal to or less than twice as large as the pitch angle of the teeth of the second gear of the camshaft, the crank phase detecting device is able to detect the phase difference corresponding to one tooth of the second gear as described above.

Two adjacent protrusions of the plurality of protrusions of the pulser rotor may be spaced apart from each other to have a pitch angle that is equal to or more than twice as large as the predetermined pitch angle. In such a configuration, the protrusions arranged on the pulser rotor are numbered, assuming that the protrusions, spaced apart from each other to have a larger pitch angle, are reference protrusions. By comparing the signal from crank phase detecting device to the signal from the cam phase detecting device, information indicating a number representing an advanced angle or a retarded angle corresponding to the phase difference is obtained. It shall be understood that the information indicating how the protrusions are numbered or the number representing the advanced or retarded angle is obtained by analysis in the computing device communicatively coupled to the engine.

The cam phase detecting device may include a rotor having at least one protrusion at a peripheral region thereof and a cam angle sensor configured to detect the protrusion of the rotor. Thus, the cam phase detecting device may be easily configured by using the rotor and the cam angle sensor.

The cam phase detecting device may include an air-intake pressure sensor configured to detect an air-intake pressure of the engine. Thus, the cam phase detecting device may be easily manufactured to include an air-intake pressure sensor. In this case, the phase of the camshaft is detectable by detecting a rising of the air-intake pressure or the like. In an engine equipped with the air-intake pressure sensor configured, for example, to set suitable ignition timings, an undesirable increase in the number of components may be avoided.

The camshaft may include a first camshaft configured to drive an intake valve and a second camshaft configured to drive an exhaust valve. The cam phase detecting device may include a first cam phase detecting device configured to detect at least one rotational phase of the first camshaft and a second cam phase detecting device configured to detect at least one rotational phase of the second camshaft. With such a configuration, the phase difference between the crankshaft and the camshaft is detectable with high accuracy in a DOHC four-cycle engine.

The first cam phase detecting device and the second cam phase detecting device may be each configured to include a rotor having at least one protrusion at a peripheral region thereof and a cam angle sensor configured to detect the protrusion of the rotor. With such a configuration, the cam phase detecting device for detecting the phase of the camshaft for driving the intake valve is easily configured by using the rotor and the cam angle sensor in the DOHC type four-cycle engine.

The first cam phase detecting device may include an air-intake pressure sensor configured to detect an air-intake pressure of the engine, and the second cam phase detecting device may include a rotor having at least one protrusion at a peripheral region thereof and a cam angle sensor configured to detect the protrusion of the rotor. With such a configuration, the phase of the camshaft for driving the intake valve is detected by using the air-intake pressure sensor and the phase of the camshaft for driving the exhaust valve is detected by using the rotor and the cam angle sensor.

The first and second gears may include sprockets and the endless rotation transmission may include a chain. The first and second gears may include toothed pulleys and the endless rotation transmission may include a toothed belt.

According to another aspect of the present invention, there is provided a system for detecting a phase difference in a four-cycle engine, comprising a four-cycle engine including a crankshaft provided with a first gear; a camshaft provided with a second gear; an endless rotation transmission that is installed around the first and second gears and is configured to transmit rotation of the crankshaft to the camshaft; a crank phase detecting device configured to detect a rotational phase of the crankshaft that is obtained by dividing a phase corresponding to one rotation of the crankshaft by a number that is equal to or more than a half of teeth of the second gear of the camshaft; and a cam phase detecting device configured to detect at least one rotational phase of the camshaft; and a phase difference detecting device configured to detect a phase difference between the crankshaft and camshaft based on a signal received from the crank phase detecting device and a signal received from the cam phase detecting device.

In such a configuration, the phase difference between the crankshaft and the camshaft may be detected with high accuracy in the four-cycle engine.

The phase difference detecting device may be configured to compare a phase of the camshaft that is predetermined with respect to the signal from the crank phase detecting device to a phase of the camshaft that is indicated by the signal from the cam phase detecting device to thereby detect the phase difference of the camshaft with respect to the crankshaft.

The phase difference detecting device may include a display configured to display the phase difference of the camshaft in a form of a numeric value of advanced or retarded teeth of the second gear of the camshaft. In such a configuration, the phase difference is detectable accurately in assembling of the engine.

The above and further objects and features of the invention will more fully be apparent from the following detailed description with accompanying drawings.

DETAILED DESCRIPTION OF THE PREFERRED EMBODIMENTS

Hereinafter, an embodiment of a four-cycle engine will be described with reference to the drawings. By way of example, a four-cycle engine mounted in a water-jet propulsion personal watercraft will be described. As used herein, the term "rightward" and "leftward" refers to rightward and leftward as a body of the watercraft is viewed from rear.

Figure 1:
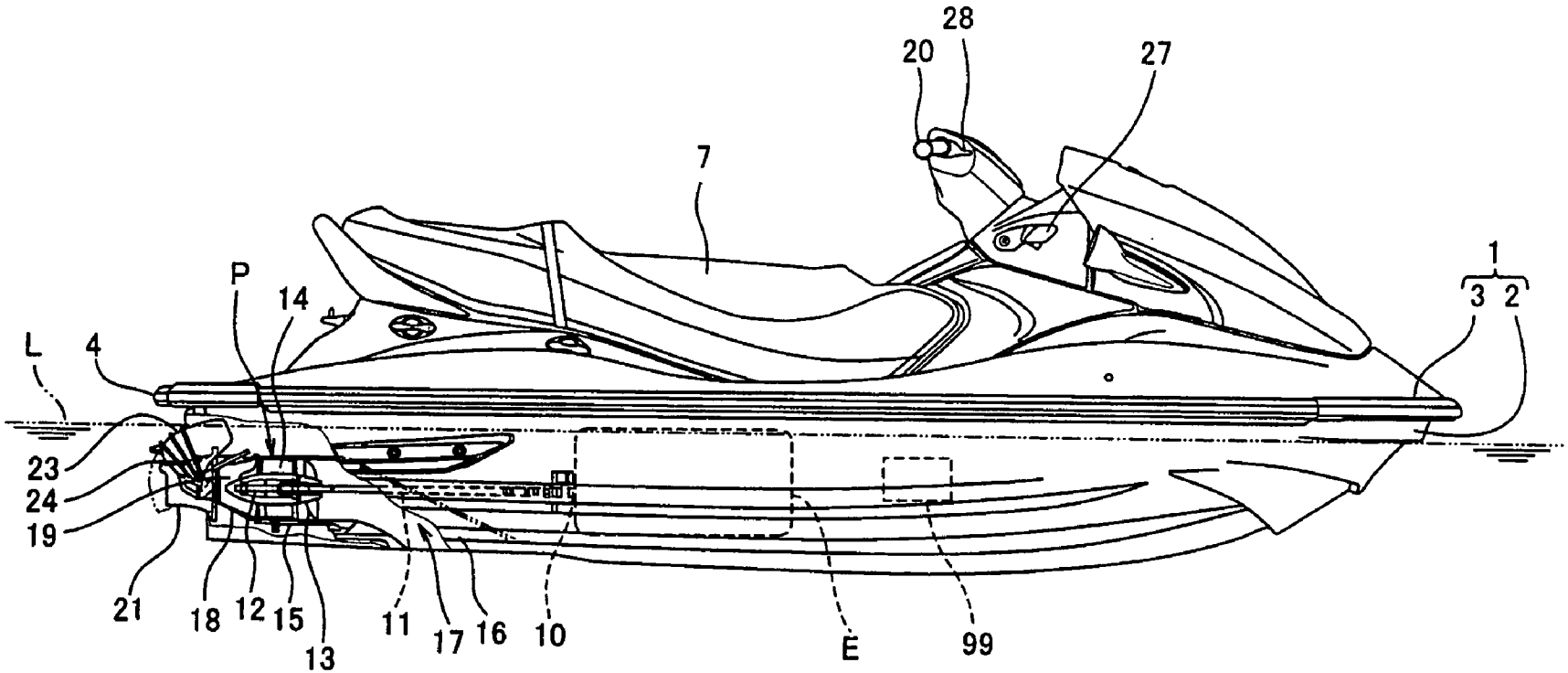
FIG. 1 is a side view showing a construction of an entire personal watercraft according to an embodiment of the present invention.
Figure 2:
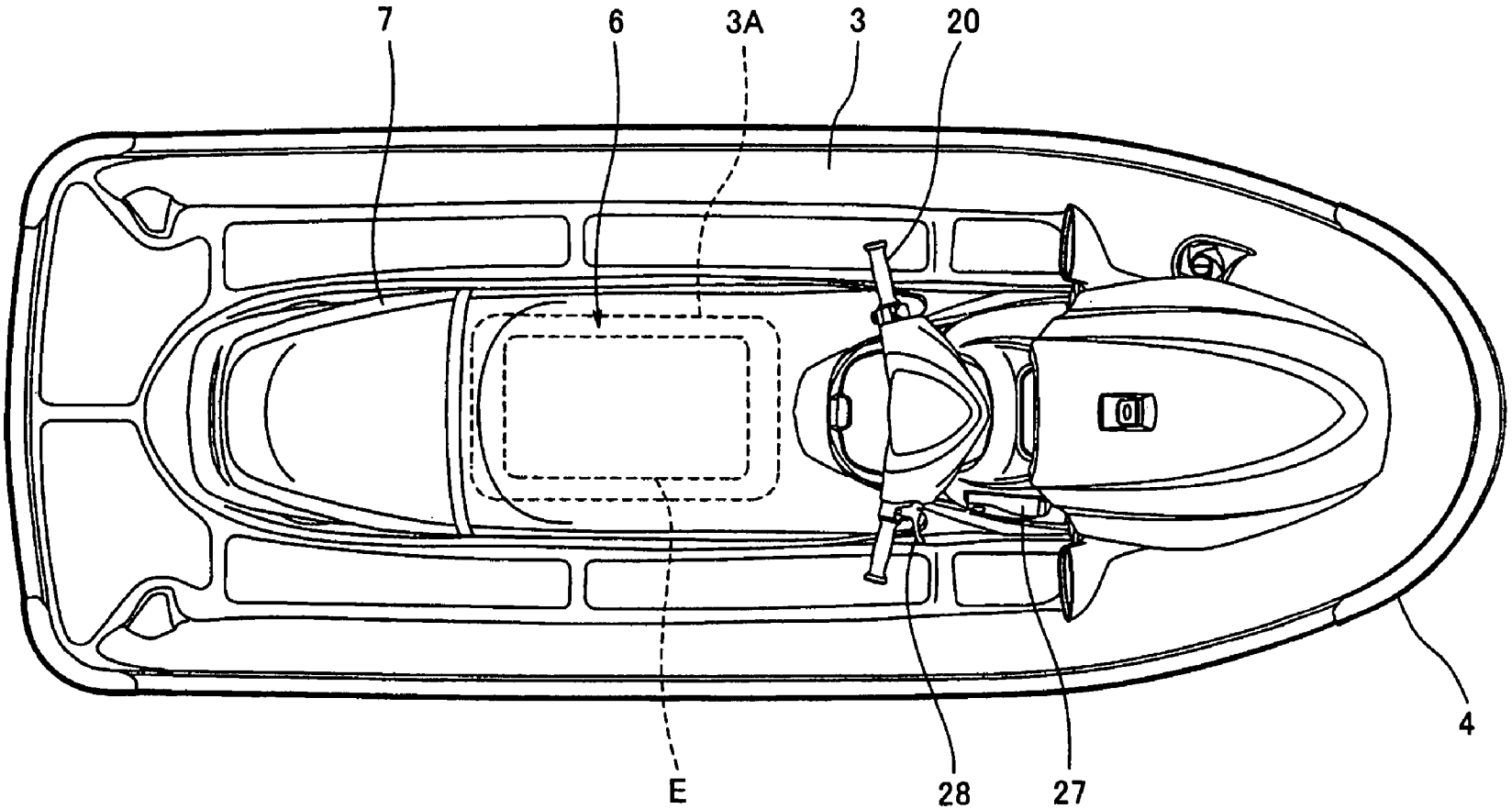
FIG. 2 is a plan view of the personal watercraft of FIG. 1.

Turning now to FIGS. 1 and 2, a body 1 of the watercraft includes a hull 2 and a deck 3 covering the hull 2 from above. A line at which the hull 2 and the deck 3 are connected over the entire perimeter thereof is called a gunnel line 4. In FIG. 1, the gunnel line 4 is located above a waterline L (indicated by two-dotted line in FIG. 1) of the personal watercraft in a state and extends substantially in parallel with the waterline L.

As indicated by a broken line of FIG. 2, a deck opening 3A, which has a substantially rectangular shape as seen from above, is formed at a substantially center section of the deck 3 in the upper portion of the body 1 such that its longitudinal direction corresponds with the longitudinal direction of the body 1. A seat 7 is removably mounted over the deck opening 3A. An engine room 6 is provided in a space defined by the hull 2 and the deck 3 below the deck opening 3A. In the engine room 6, a four-cycle engine (hereinafter referred to as an engine) E is mounted.

As shown in FIG. 1, the engine E is mounted such that a center axis of a crankshaft 10 extends along the longitudinal direction of the body 1. A rear end of the crankshaft 10 is coupled to a pump shaft 12 of the water jet pump P through a propeller shaft 11. Therefore, the crankshaft 10 is configured to rotate integrally with the pump shaft 12. An impeller 13 is attached on the pump shaft 12. The impeller 13 is covered with a cylindrical pump casing 15 on the outer periphery thereof.

A water intake 16 is provided on the bottom of the hull 2. The water is taken in through the water intake 16 and is fed to the water jet pump P through a water passage 17. The water jet pump P causes the impeller 13 to pressurize and accelerate the water and then causes fairing vanes 14 to guide the water behind the impeller 13. The water jet pump P ejects the water through a pump nozzle 18 having a cross-sectional area that is gradually reduced rearward, and from an outlet port 19 provided on the rear end of the pump nozzle 18. As the resulting reaction, the personal watercraft obtains a propulsion force.

As shown in FIGS. 1 and 2, a bar-type steering handle 20 is connected to a steering nozzle 21 positioned behind the pump nozzle 18 through a cable (not shown). The steering nozzle 21 is pivotable rightward and leftward around a pivot (not shown). The steering handle 20 cooperates with the steering nozzle 21. When the rider rotates the handle 20 clockwise or counterclockwise, the steering nozzle 21 pivots toward the opposite direction so that the ejection direction of the water being ejected through the pump nozzle 21 can be changed, and the watercraft can be correspondingly turned to any desired direction while the water jet pump P is generating the propulsion force.

As shown in FIG. 1, a bowl-shaped reverse deflector 23 is provided on an upper portion on the rear side of the steering nozzle 21 such that it is vertically pivotable around a pivot shaft 24 that is oriented horizontally. As shown in FIGS. 1 and 2, a reverse switching lever 27 is attached to the body 1 in front of the right handle 20 and is configured to switch between forward travel and rearward travel.

Figure 3:
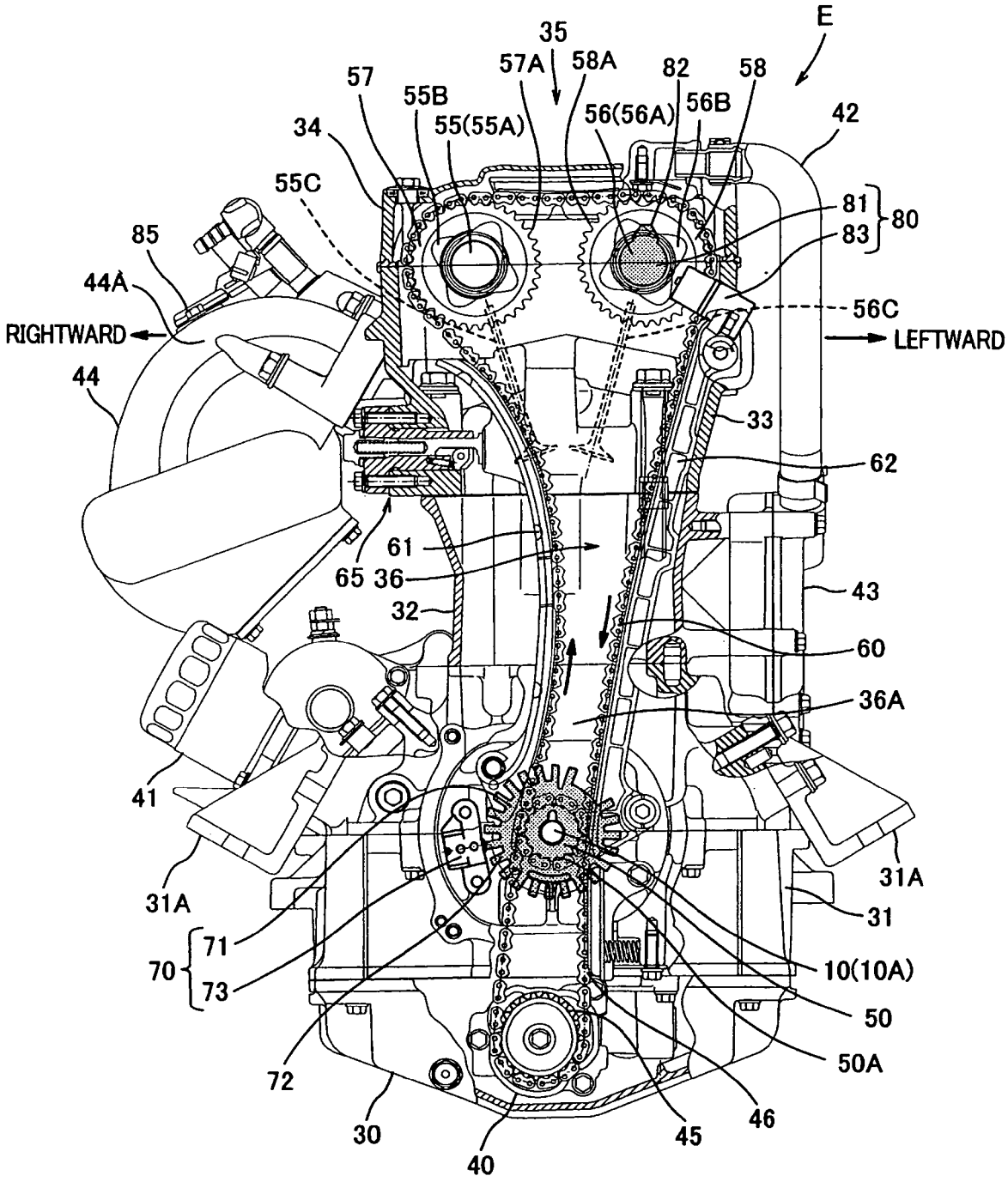
FIG. 3 is a front view of a construction of an engine mounted in the personal watercraft of FIG. 1, a part of which is cut away to illustrate a construction of a valve system.

FIG. 3 is a front view of a construction of the engine E mounted in the personal watercraft of FIG. 1, a part of which is cut away to illustrate a construction of a valve system. The engine E illustrated in FIG. 3 is a double overhead camshaft (DOHC) type four-cycle four-cylinder engine.

As shown in FIG. 3, the engine E includes a crankcase 31 that is provided with an oil pan 30 on a lower portion thereof and is divided into two parts vertically arranged, a cylinder block 32 connected to an upper portion of the crankcase 31 and configured to accommodate a piston (not shown) reciprocatable therein, a cylinder head 33 that is connected to an upper portion of the cylinder block 32 and is configured to substantially accommodate a camshaft (first camshaft) 55 configured to drive an intake valve 55C for taking in air and a camshaft (second camshaft) 56 configured to drive an exhaust valve 56C for exhausting a gas, and a cylinder head cover 34 provided to cover the cylinder head 33 from above.

Engine mounts 31A are mounted to right and left outer wall portions of the crankcase 31. The engine E is mounted to the body 1 (see FIG. 1) in such a manner that the engine mounts 31A are fastened to an inner bottom surface of the hull 2 (see FIG. 1) with dampers (not shown) sandwiched between them. The engine E is placed within the engine room 6 (see FIG. 2) in such a manner that each cylinder 35 including the cylinder block 32, the cylinder head 33, and so on is oriented to extend vertically.

An oil pump 40 is housed in the oil pan 30. An oil filter 41 is attached to the right outer wall portion of the crankcase 31 and configured to remove unwanted substances from the oil. The oil pump 40 pumps oil from the oil pan 30 to flow the oil into engine components of the engine E through the oil filter 41 and oil paths (not shown). A breather pipe 42 extends outward from an upper portion of the cylinder head cover 34 and then downward along a left wall portion of the engine E, and is connected to an oil separator 43 secured to a left wall portion of the cylinder block 32 by fasteners. Oil mist generated in a cam chamber formed inside the cylinder head cover 34 is guided to the oil separator 43 through the breather pipe 42, and is separated into liquid oil and a gas therein. An air-intake pipe 44 extends outward from a right wall portion of the cylinder head 33. Air is taken into the engine room 6 (see FIG. 2) from outside the watercraft and is guided to a combustion chamber (not shown) of the engine E through the air-intake pipe 44.

A front portion of the crankcase 31, a front portion of the cylinder block 32, a front portion of the cylinder head 33, and a front portion of the cylinder head cover 34 respectively have double-walled structures. A chain tunnel 36 is formed between wall portions of the double-walled structure and configured to extend vertically. In FIG. 3, an outer (front) wall portion is omitted from the wall portions of the double-wall structure forming the chain tunnel 36 to illustrate an internal structure of the chain tunnel 36.

The crankshaft 10 is housed in the crankcase 31. A front end portion 10A of the crankshaft 10 extends through a rear wall portion 36A of the chain tunnel 36 and protrudes into the chain tunnel 36. Two crank sprockets (first gear) 50 each having a plurality of teeth 50A (17 teeth in this embodiment) are mounted on the front end portion 10A of the crankshaft 10 and are configured to rotate integrally with the crankshaft 10. In FIG. 3, only an outer (front) crank sprocket is illustrated. A drive pump sprocket 45 is mounted on the oil pump 40 mounted within the oil pan 30. A pump drive chain 46 is installed around the inner (rear) crank sprocket 50 and the pump sprocket 45. The oil pump 40 is driven in cooperation with rotation of the crankshaft 10.

The camshaft 55 configured to drive the intake valve 55C and the camshaft 56 configured to drive the exhaust valve 56C are positioned between an upper portion of the cylinder head 33 and a lower portion of the cylinder head cover 34. The camshafts 55 and 56 are mounted in such a manner that their axial direction is parallel to the longitudinal direction of the crankshaft 10 and the camshaft 55 is located on the right side of the camshaft 56. The camshaft 55 and the camshaft 56 are provided with a cam 55*b* and a cam 56B corresponding to each cylinder 35 of the engine E, respectively. The cams 55B and 56B drive the intake valve 55C and the exhaust valve 56C (indicated by broken lines of FIG. 3), causing intake and exhaust ports (not shown) of the engine E to open and close.

A front end portion 55A of the camshaft 55 extends through the rear wall portion 36A of the chain tunnel 36 and protrudes into the chain tunnel 36. A cam sprocket (second gear) 57 is mounted on the front end portion 55A of the camshaft 55 and is configured to rotate integrally with the camshaft 55. A front end portion 56A of the camshaft 56 extends through the rear wall portion 36A of the chain tunnel 36 and protrudes into the chain tunnel 36. A cam sprocket (second gear) 58 is mounted on the front end portion 56A of the camshaft 56 and is configured to rotate integrally with the camshaft 56.

The cam sprocket 57 and the cam sprocket 58 of this embodiment are of a disc shape. Teeth 57A having 34 teeth and teeth 58A having 34 teeth which are twice as many as 17 teeth of the crank sprocket 50 are respectively formed at peripheral regions of the cam sprocket 57 and the cam sprocket 58 in such a manner that they are arranged at equal intervals in the circumferential direction of the sprockets 57 and 58 so as to protrude radially outward. A timing chain (endless rotation transmission) 60 is installed around the outer (front) crank sprocket 50, the cam sprocket 57, and the cam sprocket 58 in mesh with the teeth 50A, 57A, and 58A. In this construction, the rotation of the crankshaft 10 is transmitted through the timing chain 60, causing the camshaft 55 and the camshaft 56 to rotate. In the engine E of this embodiment, the crankshaft 10 rotates clockwise in FIG. 3, causing the timing chain 60, the camshaft 55, and the camshaft 56 to rotate clockwise.

A movable chain slack guide 61 and a fixed chain guide 62 are mounted in the interior of the chain tunnel 36. The chain slack guide 61 vertically extends on the right side of the timing chain 60. The chain slack guide 61 is pivotally mounted at a lower end portion thereof to a region of a wall of the crankcase 31 near and above the crank sprocket 50. An upper end portion of the chain slack guide 61 is positioned near and below the cam sprocket 57. A tensioner 65 is mounted on a right wall portion of the cylinder head 33 and is configured to bias an upper portion of the chain slack guide 61 to the left. The tensioner 65 supports the timing chain 60 from the right with the chain slack guide 61 interposed between them, to apply a suitable tension to the timing chain 60.

The fixed chain guide 62 vertically extends on the left side of the timing chain 60 in the interior of the chain tunnel 36 from a position near the left side of the crank sprocket 50 to a position below and near the cam sprocket 58. The chain guide 62 supports the timing chain 60 from the left by a groove (not shown) formed on a right side portion thereof to extend in a longitudinal direction thereof. A left portion of the timing chain 60 is accommodated in the groove of the chain guide 62. The timing chain 60 is movable along the groove.

A crank phase detecting device 70 is mounted in the vicinity of the front end portion 10A of the crankshaft 10 in the interior of the chain tunnel 36 and is configured to detect a rotational phase of the crankshaft 10. The crank phase detecting device 70 includes a pulser rotor 71 configured to rotate integrally with the crankshaft 10. The pulser rotor 71 is of a disc shape and is provided with a plurality of protrusions 72 at a peripheral region thereof. The crank phase detecting device 70 further includes a crank angle sensor 73 attached to the rear wall portion 36A of the chain tunnel 36 in the interior of the chain tunnel 36. The crank angle sensor 73 is positioned close to the peripheral region of the pulser rotor 71. The crank angle sensor 73 is configured to detect a distance between the sensor 73 and the peripheral region of the pulser rotor 71 rotatable integrally with the crankshaft 10, and to output a signal P (see FIGS. 7 and 8) having a pulse each time the crank angle sensor 73 detects that the protrusion 72 is present in its front.

Figure 4:
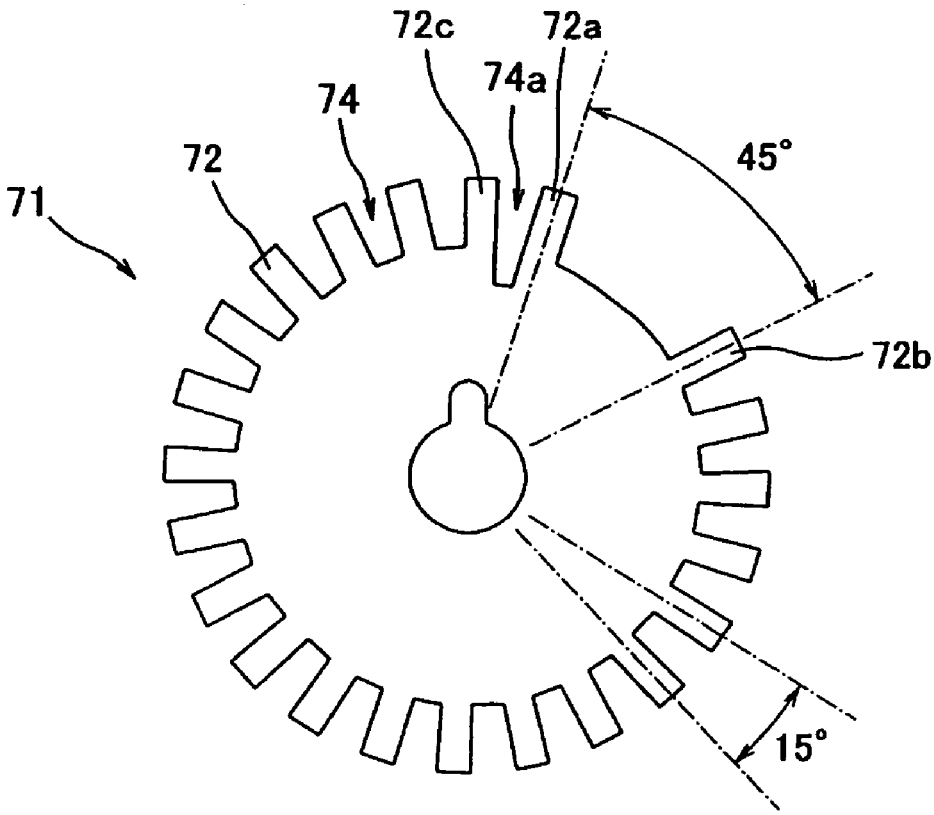
FIG. 4 is a view showing a structure of a pulser rotor equipped in the engine of FIG. 3.

FIG. 4 is a view showing a structure of the pulser rotor 71. As shown in FIG. 4, a number of (22 in this embodiment) protrusions 72 of a substantially rectangular shape are formed at the peripheral region of the pulser rotor 71 of a disc shape so as to protrude radially outward. The protrusions 72 are arranged in the circumferential direction of the pulser rotor 71 at an equal pitch angle of 15 degrees, except two predetermined adjacent protrusions 72*a* and 72*b* arranged to be spaced apart from each other at an angle of 45 degrees, which is three times as large as 15 degrees (obtained by dividing 360 degrees by 24). A recess 74*a* is positioned between the protrusion 72*a* (located counterclockwise relative to the protrusion 72*b*) and a protrusion 72*c* (located adjacent the protrusion 72*a* and counterclockwise relative to the protrusion 72*a*). The recess 74*a* is deeper than the remaining recesses 74 formed between adjacent protrusions 72.

As shown in FIG. 3, a cam phase detecting device 80 is mounted in the vicinity of the front end portion 56A of the camshaft 56 configured to drive the exhaust valve 56C and is configured to detect a rotational phase of the camshaft 56. The cam phase detecting device 80 includes a rotor 81 mounted on the front end portion 56A of the camshaft 56 in the interior of the chain tunnel 36. The rotor 81 is configured to rotate integrally with the camshaft 56 and is provided with a protrusion 82 at a peripheral region thereof. The cam phase detecting device 80 further includes a cam angle sensor 83 attached to the left wall portion of the cylinder head 33. The cam angle sensor 83 is positioned a predetermined distance apart from the peripheral region of the rotor 81. The cam angle sensor 83 is configured to detect a distance between the sensor 83 and the peripheral region of the rotor 81 configured to rotate integrally with the camshaft 56 and to output a signal Q (see FIG. 7) having a pulse each time the cam angle sensor 83 detects that the protrusion 82 is present in its front.

An air-intake pressure sensor 85 is attached to the air-intake pipe 44 extending from the right wall portion of the cylinder head 33 and is configured to detect an air pressure in the interior of the air-intake pipe 44. The air-intake pipe 44 extends rightward and upward from the right wall portion of the cylinder head 33 and is curved at a position to extend downward. The air-intake pressure sensor 85 is attached to an outer region of a curved portion 44A of the air-intake pipe 44. The air-intake pressure sensor 85 is configured to detect an air pressure in the interior of the air-intake pipe 44 that vary according to an operation of the intake valve 55C, and to output a signal R (see FIG. 8) regarding the detected air pressure.

Figure 5:
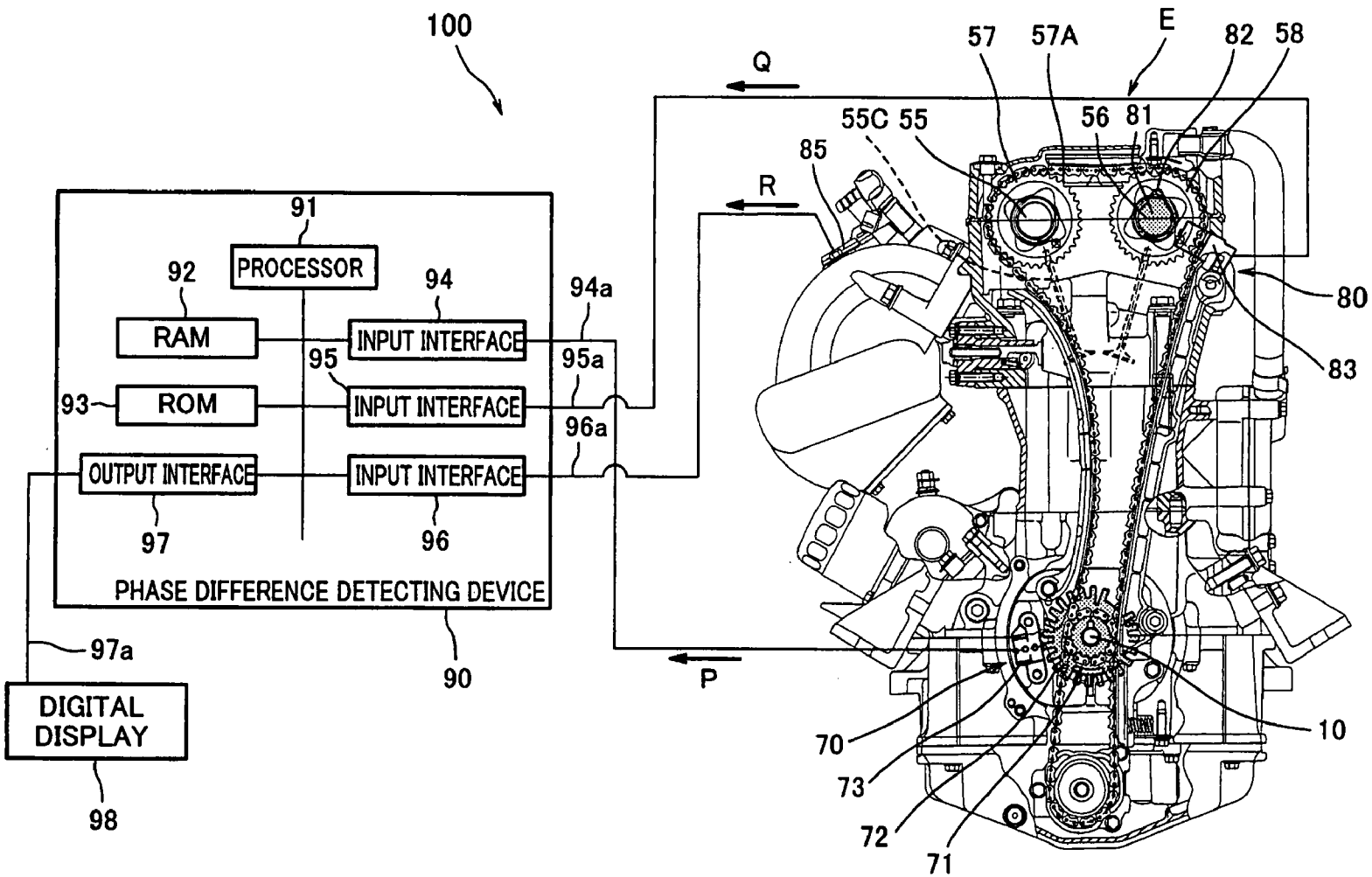
FIG. 5 is a view schematically showing a configuration of a system for detecting a phase difference between a crankshaft, and camshafts respectively configured to drive an intake valve and an exhaust valve.

A procedure for detecting a phase difference between the crankshaft 10 and the camshaft 55 or the camshaft 56 in the engine E of this embodiment will be described. FIG. 5 is a view schematically showing a configuration of a system 100 configured to detect the phase difference. As shown in FIG. 5, the system 100 is configured in such a manner that the engine E is communicatively coupled to the phase difference detecting device 90 positioned outside the engine E through signal lines. The phase difference detecting device 90 may be incorporated in a computing device, for example, electrical control unit (ECU) 99 (see FIG. 1) which is typically built in the body 1 of the personal watercraft. Alternatively, the phase difference detecting device may be incorporated into a remotely connected computing device that is configured to be linked to each of the sensors 73, 83, 85. The computing device may be, for example, a hand-held portable computing device for ease of use in the manufacturing process.

The phase difference detecting device 90 includes a processor 91, RAM 92, ROM 93, input interfaces 94 to 96, and an output interface 97. The processor 91 computes data loaded from the RAM 92 or the ROM 93 or data externally input through the input interfaces 94 to 96 and outputs computed data. The RAM 92 temporarily stores the computed data from the processor 91 or the data externally input. The ROM 93 contains various programs to enable the processor 91 to operate.

The input interface 94 is coupled to the crank angle sensor 73 of the crank phase detecting device 70 through a signal line 94*a*. The input interface 95 is coupled to the cam angle sensor 83 of the cam phase detecting device 80 through a signal line 95*a*. The input interface 96 is coupled to the air-intake pressure sensor 85 of a cam phase detecting device through a signal line 96*a*. A digital display 98 is coupled to the output interface 97 through a signal line 97*a*, and is configured to display alphanumeric or other messages in accordance with an instruction from the processor 91.

Figure 6:
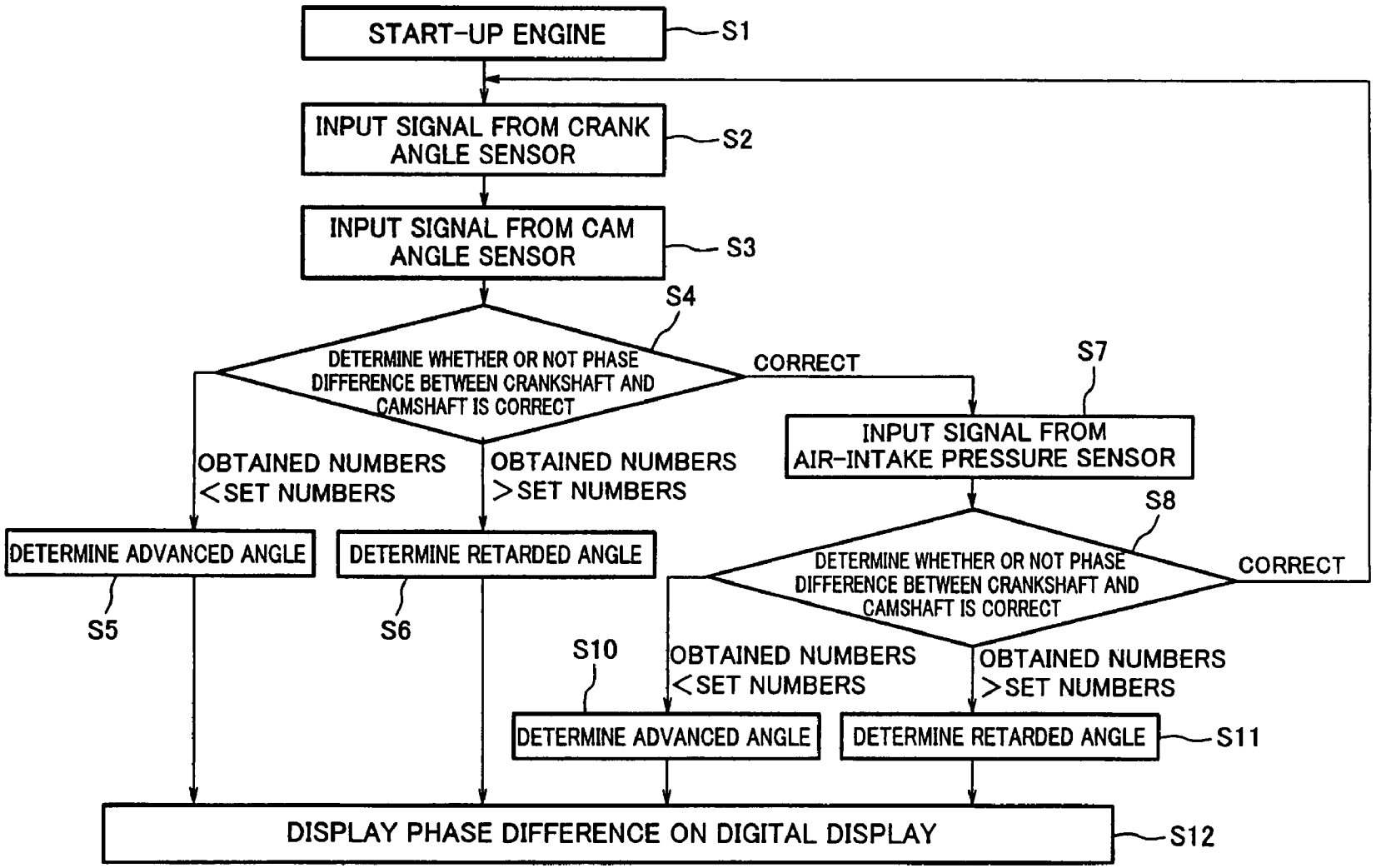
FIG. 6 is a flowchart showing an example of an operation of a phase difference detecting device included in the system of FIG. 5.

FIG. 6 is a flowchart showing an example of an operation of the phase difference detecting device 90. As shown in FIG. 6, when the engine E starts-up (S1), the signal P is output from the crank angle sensor 73 and input to the phase difference detecting device 90 through the signal line 94*a* (S2), and the signal Q is output from the cam angle sensor 83 and input to the phase difference detecting device 90 through the signal line 95*a* (S3). Based on the signals P and Q, the phase difference detecting device 90 determines whether or not the phase difference between the crankshaft 10 and the camshaft 56 is correct (S4).

Figure 7:
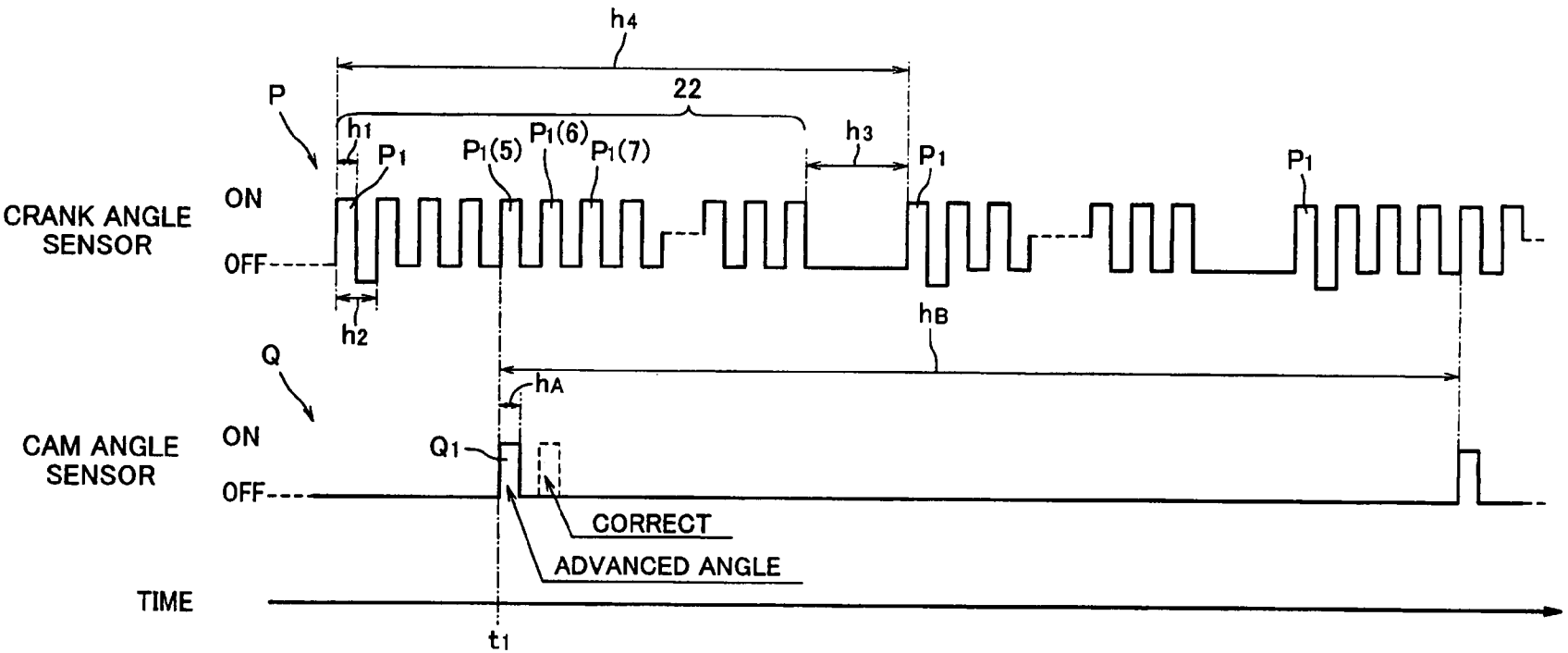
FIG. 7 is a timing chart showing examples of a signal output from a crank angle sensor and input to the phase difference detecting device of FIG. 5 and a signal output from a cam angle sensor and input to the phase difference detecting device.

FIG. 7 is a timing chart showing an example of the signals P and Q input to the phase difference detecting device 90. As shown in FIG. 7, the signal P from the crank angle sensor 73 generates a pulse $P_1$ in ON-state for a time period $h_1$ continuously at intervals of a relatively short time period $h_2$, and then turns to OFF-state for a relatively long time period $h_3$ ($h_3>h_2$), which is followed by the pulse $P_1$ generated continuously at intervals of the time period $h_2$.

Each pulse $P_1$ is generated each time the crank angle sensor 73 detects that any one of the protrusions 72 of the pulser rotor 71 is present near the sensor 73 during rotation of the crankshaft 10. The time period $h_1$ is a time period required for one protrusion of the protrusions 72 to pass through the front of the crank angle sensor 73. The time period $h_2$ is a time period required for one protrusion of the protrusions 72 (e.g., protrusion 72*a* of FIG. 4) and its adjacent recess 74 (e.g., recess 74*a* of FIG. 4) to pass through the front of the crank angle sensor 73. The time period $h_3$ is a time period that elapses from when the crank angle sensor 73 detects the protrusion 72*b* until the crank angle sensor 73 detects the protrusion 72*a* spaced 45 degrees apart from the protrusion 72*b*. As can be seen from FIG. 7, a time period $h_4$ elapses from when the crank angle sensor 73 detects the protrusion 72*a* (FIG. 4) first until the crank angle sensor 73 detects the protrusion 72*a* next, and is equal to a time period required per rotation of the crankshaft 10.

The phase difference detecting device 90 counts each pulse $P_1$. Specifically, after detecting that the pulse P is in OFF-state for the time period $h_3$, the phase difference detecting device 90 sequentially counts the pulses $P_1$ generated continuously at intervals of the time period $h_2$ that is shorter than the time period $h_3$ in such a manner that the detecting device 90 counts from "1" to "22" corresponding to 22 protrusions of the protrusions 72 of the pulser rotor 71 and assign numbers to each counted protrusion, e.g. "No. 1, No. 2 . . . ." After that, when detecting that the pulse P is in OFF-state for the time period $h_3$ again, the phase difference detecting device 90 resets the count, and re-counts the pulses $P_1$. In this manner, the phase difference detecting device 90 detects the rotational phase of the crankshaft 10 at a pitch angle of 15 degrees.

As described above, the phase difference detecting device 90 compares the time period $h_2$ to the time period $h_3$ to detect the first pulse $P_1$ (No. 1 pulse $P_1$), namely, signal waveform generated when the phase difference detecting device 90 detects the presence of the protrusion 72*a* in FIG. 4. While the time periods $h_2$ and $h_3$ vary according to an engine speed of the engine E, the phase difference detecting device 90 is able to reliably determine that the time period $h_2$ is shorter than the time period $h_3$, because the pulser rotor 71 of the engine E of this embodiment is constructed in such a manner that the protrusions 72*a* and 72*c* are apart from each other at a pitch angle of 15 degrees, while the protrusions 72*a* and 72*b* are spaced apart from each other at a pitch angle of 45 degrees. Furthermore, since the recess 74*a* between the protrusions 72*a* and 72*c* is deeper than the recess 74 between other adjacent protrusions 72, the waveform corresponding to the recess 74*a* is deeper than the waveform corresponding to the recess 74 in the signal P from the crank angle sensor 73 (see FIG. 7). Since the pulse $P_1$ corresponding to the protrusion 72*a* has a potential difference between ON-state and OFF-state that is larger than that of other protrusions 72, the crank angle sensor 73 is able to detect the protrusion 72*a* with high accuracy.

The signal Q from the cam angle sensor 83 generates a rectangular pulse $Q_1$ in ON-state for a time period $h_A$ continuously at intervals of a relatively long time period $h_B$. Each pulse $Q_1$ is generated each time the cam angle sensor 83 detects that the protrusion 82 of the rotor 81 mounted on the camshaft 56 is present near the sensor 83 during rotation of the camshaft 56. The time period $h_A$ is a time period required for the protrusion 82 to pass through the front of the cam angle sensor 83. The time period $h_B$ is a time period required per rotation of the camshaft 56, and is twice as long as the time period $h_4$ required per rotation of the crankshaft 10.

The ROM 93 (see FIG. 5) of the phase difference detecting device 90 contains programs to determine whether or not the crankshaft 10 and the camshaft 56 are rotating with a correct phase difference between them, based on the signals P and Q. The step S4 of FIG. 6 is implemented by the operation of the processor 91 based on the programs. Upon detecting the pulse $Q_1$ (rising of the pulse $Q_1$ in this embodiment) generated in the signal Q from the cam angle sensor 83, the processor 91 obtains numbers of pulses $P_1$ generated in the signal P from the crank angle sensor 73. By way of example, as shown in FIG. 7, upon detecting the pulse $Q_1$ in the signal Q from the cam angle sensor 83 at time $t_1$, the processor 91 obtains numbers (5, 6) of the pulse $P_1$ (5) and the pulse $P_1$ (6) which are generated in the signal P from the crank angle sensor 73 near the time $t_1$. Then, the processor 90 determines whether or not the numbers (5, 6) match preset serial numbers. The reason why the processor 90 obtains the serial numbers is that the pulse $Q_1$ and the pulse $P_1$ are typically output with a slight time lag.

If it is determined that the obtained numbers (5, 6) are smaller than the preset numbers, the processor 90 determines that the phase of the camshaft 56 is ahead of the phase of the crankshaft 10 by the difference in numbers (S5), and sends a predetermined signal to the digital display 98 through the output interface 97 and the signal line 97*a*. The digital display 98 receives the signal, and displays a message stating that the phase of the camshaft 56 is ahead of a correct angle, and an advanced angle (S12). According to the message and the advanced angle displayed on the digital display 98, an operator or the like re-installs the timing chain 60. In this manner, the camshaft 56 is easily set to have a correct phase difference with respect to the crankshaft 10.

Assuming that the preset numbers are (6, 7), the processor 90 may determine that the phase difference is correct if the cam angle sensor 83 detects the protrusion 82 of the rotor 81 as indicated by a broken line in the signal Q of FIG. 7 while the crank angle sensor 73 is detecting a sixth protrusion of the protrusions 72 (corresponding to a pulse $P_1$ (6) in FIG. 7) and a seventh protrusion of the protrusions 72 (corresponding to a pulse $P_1$ (7) in FIG. 7). On the other hand, if the obtained numbers are (5, 6), the processor 90 may determine that the phase of the camshaft 56 is ahead of the phase of the crankshaft 10 by 15 degrees.

As described with reference to FIG. 4, the engine E of this embodiment is configured such that the protrusions 72 of the pulser rotor 71 are arranged at an equal pitch angle of 15 degrees. Since the cam sprocket 58 rotates once while the pulser rotor 71 rotates twice, the phase difference corresponding to one protrusion of the protrusions 72 of the pulser rotor 71 corresponds to the phase difference of 7.5 (15/2) degrees in terms of the rotational angle of the cam sprocket 58. The cam sprocket 58 has 34 teeth in total which are arranged at a pitch angle of about 10.5 degrees. Therefore, the system 100 is able to detect the phase difference corresponding to one tooth of the teeth 58A of the cam sprocket 58. The digital display 98 of FIG. 5 is configured to display how many teeth 58A of the cam sprocket 58 are ahead of or behind the protrusions 72 of the pulser rotor 71. Thus, the phase difference of the camshaft 56 is accurately detectable.

If it is determined that the obtained numbers (5, 6) are larger than the preset numbers in step S4 of FIG. 6, the processor 90 determines that the phase of the camshaft 56 is behind the phase of the crankshaft 10 by the difference in numbers (S6), and sends a predetermined signal to the digital display 98. The digital display 98 receives the signal and displays a message stating that the phase of the camshaft 56 is behind a correct angle and a retarded angle (S12).

If it is determined that the obtained numbers (5, 6) match the preset numbers in step S4 of FIG. 6, the processor 90 determines that the camshaft 56 and the crankshaft 10 are set with a correct phase difference, and then receives the signal R from the air-intake pressure sensor 85 (S7). Based on the signal R from the air-intake pressure sensor 85 and the signal P input from the crank angle sensor 73 in step S2, the phase difference detecting device 90 determines whether or not a phase difference between the crankshaft 10 and the camshaft 55 is correct (S8).

Figure 8:
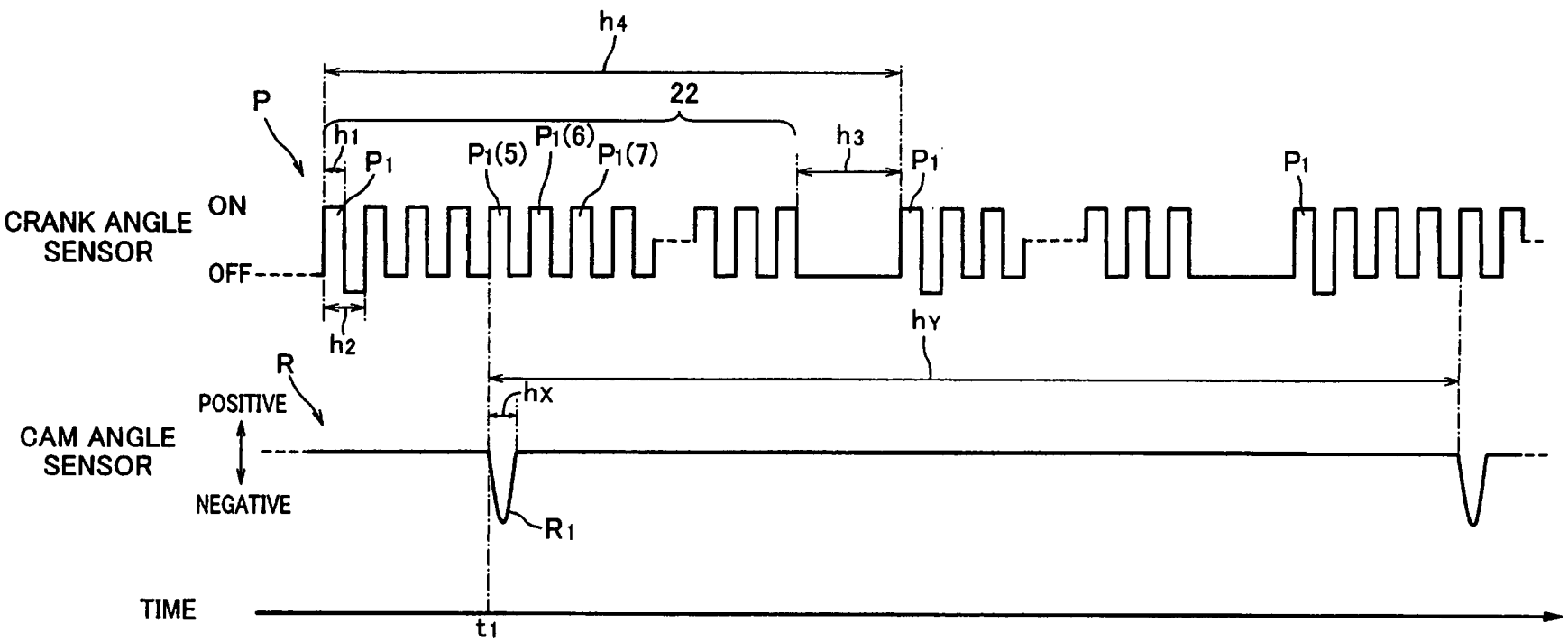
FIG. 8 is a timing chart showing examples of a signal output from the crank angle sensor and input to the phase difference detecting device of FIG. 5 and a signal output from the air-intake pressure sensor and input to the phase difference detecting device.

FIG. 8 is a timing chart showing examples of the signals P and R input to the phase difference detecting device 90. The signal P in FIG. 8 is identical to the signal P from the crank angle sensor 73 that is illustrated in FIG. 7 and therefore, will not be further described. As shown in FIG. 8, the signal R from the air-intake pressure sensor 85 has a substantially constant value that continues for a predetermined time period and then varies to form a negative-pressure wave $R_1$ with a negative peak for a time period $h_X$ by opening and closing the intake valve 85, which is repeated at intervals of a time period $h_Y$ required per rotation of the camshaft 55. The time period $h_Y$ is twice as long as the time period $h_4$ required per rotation of the crankshaft 10.

The ROM 93 (see FIG. 5) included in the phase difference detecting device 90 contains programs to determine whether or not the crankshaft 10 and the camshaft 55 are rotating with a correct phase difference, based on the signals P and R. The step S8 of FIG. 6 is implemented by an operation of a processor 91 based on the programs.

Upon detecting the presence of the negative-pressure wave $R_1$ (appropriate points that are references such as a rising of the negative pressure) in the signal R from the air-intake pressure sensor 85, the processor 91 obtains numbers of the pulse $P_1$ generated in the signal P from the crank angle sensor 73. Then, the processor 91 determines whether or not the obtained numbers match preset serial numbers, in the same manner that the phase difference between the crankshaft 10 and the camshaft 56 is detected, which will not be further described.

If it is determined that the obtained numbers are smaller than the preset numbers, the processor 91 determines that the phase of the camshaft 55 is ahead of the phase of the crankshaft 10 by the difference in numbers (S10), and sends a predetermined signal to the digital display 98 through the output interface 97 and the signal line 97*a*. The digital display 98 receives the signal, and displays a message stating that the phase of the camshaft 55 is ahead of a correct angle, and an advanced angle, based on the received signal (S12).

If it is determined that the obtained numbers are larger than the preset numbers, the processor 91 determines that the phase of the camshaft 55 is behind the phase of the crankshaft 10 by the difference in numbers (S11), and sends a predetermined signal to the digital display 98. The digital display 98 receives the signal, and displays a message stating that the phase of the camshaft 55 is behind a correct angle, and a retarded angle, based on the received signal (S12).

If it is determined that the obtained numbers match the preset numbers in step S8, the processor 91 determines that the camshaft 55 and the crankshaft 10 are set with a correct phase difference, and repeats the operation in the step S2 and the following steps. If it is determined that the camshaft 55 and the crankshaft 10 are set with a correct phase difference in step S8, the processor 91 may cause the digital display 98 to display a message stating that they are set with the correct phase difference.

In the engine E of this embodiment, as described above, the cam sprocket 57 and the cam sprocket 58 have 34 teeth, respectively, while the pulser rotor 71 mounted on the crankshaft 10 have 22 protrusions arranged at a pitch angle of 15 degrees in the circumferential direction thereof. Therefore, the system 100 is able to detect the phase difference corresponding to one tooth of the teeth 57A and one tooth of the teeth 58A of the cam sprockets 57 and 58, respectively.

The system 100 is able to detect the phase difference corresponding to one tooth of the teeth 57A or one tooth of the teeth 58A with high accuracy so long as the crank phase detecting device 70 is capable of detecting a rotational phase of the crankshaft 10 which is obtained by dividing the phase (360 degrees) corresponding to one rotation of the crankshaft 10 by a number that is equal to or more than a half of the teeth of the cam sprocket (second gear) 57 or the cam sprocket (second gear) 58. In other words, it is necessary that the pitch angle of the protrusions 72 of the pulser rotor 71 be equal to or less than twice as large as the pitch angle of the teeth 57A of the cam sprocket 57 or the teeth 58A of the cam sprocket 58.

While the engine E is configured in such a manner that the rotational phase of the camshaft 55 is detected by using the air-intake pressure sensor 85 and the rotational phase of the camshaft 56 is detected by using the rotor 81 and the cam angle sensor 83, the rotational phase of the camshaft 55 and the rotational phase of the camshaft 56 may alternatively be detected by using the rotor 81 and the cam angle sensor 83.

Figure 9:
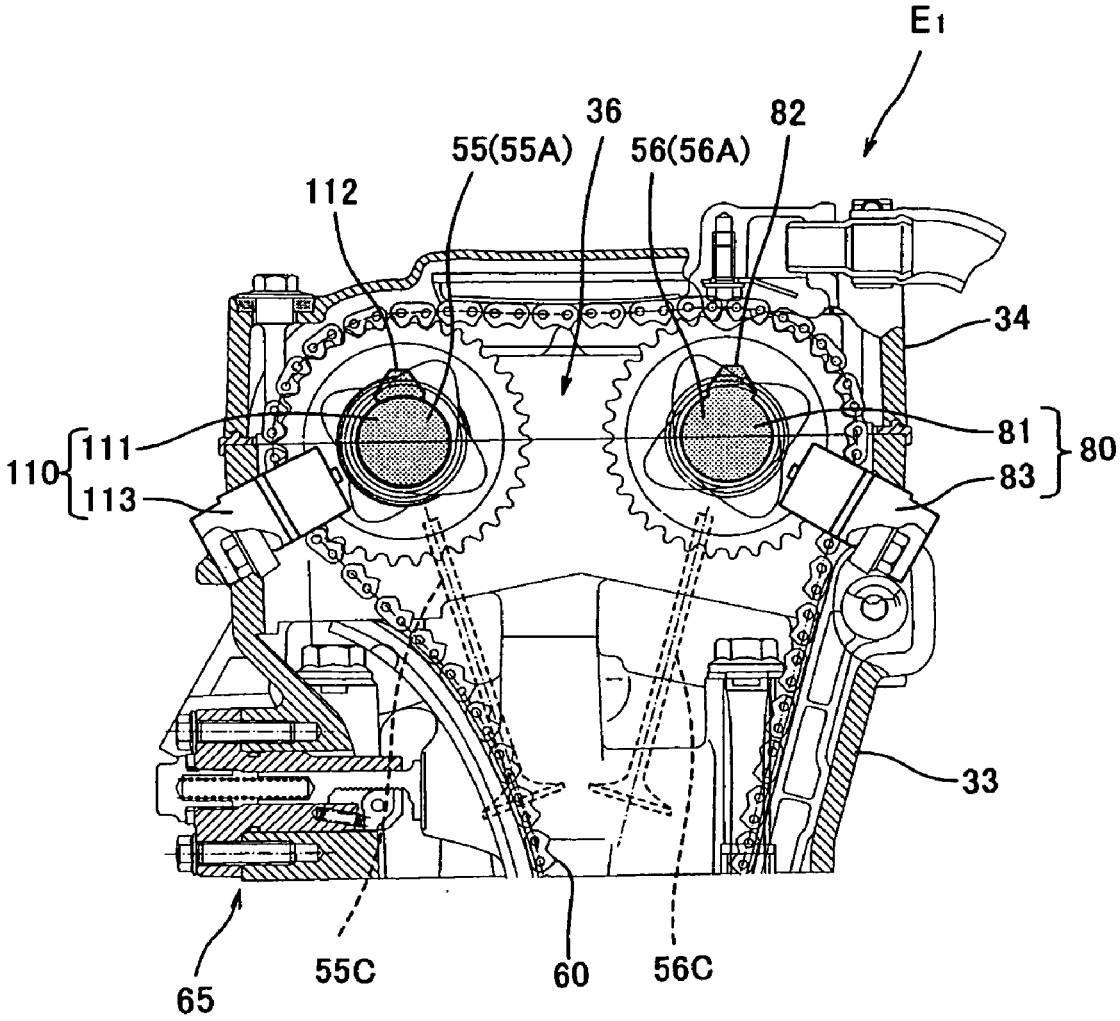
FIG. 9 is an enlarged front view of another engine configured to detect rotational phases of the camshafts using the rotor and the cam angle sensor, showing a region surrounding a cylinder head.

FIG. 9 is an enlarged front view showing a region surrounding the cylinder head 33 of an engine $E_1$ configured to detect the rotational phase of the camshaft 55 and the rotational phase of the camshaft 56 by using the rotor 81 and the cam angle sensor 83. As shown in FIG. 9, the cam phase detecting device 80 is mounted in the vicinity of the front end portion 56A of the cylinder head 56 and is configured to detect the phase of the camshaft 56 configured to drive the exhaust valve 56C. The cam phase detecting device 80 includes the rotor 81 and the cam angle sensor 83. The configuration of cam phase detecting device 80 is similar to that described with reference to FIG. 3.

A cam phase detecting device 110 is mounted in the vicinity of the front end portion 55A of the camshaft 55 and is configured to detect the rotational phase of the camshaft 55 configured to drive the intake valve 55C. The configuration of the cam phase detecting device 110 is similar to that of the cam phase detecting device 80. The cam phase detecting device 110 includes a rotor 111 mounted on the front end portion 55A of the camshaft 55 and a cam angle sensor 113 attached to a right wall portion of the cylinder head 33 in the interior of the chain tunnel 36. The rotor 111 is provided with a protrusion 112 at a peripheral region thereof. The cam angle sensor 113 is configured to detect a distance between the sensor 113 and the peripheral region of the rotor 111 configured to rotate integrally with the camshaft 55 and to output a signal having a pulse to outside each time the sensor 113 detects that the protrusion 112 is present in its front.

When the system 100 is configured using the engine $E_1$, the cam angle sensor 113 of the cam phase detecting device 110 is coupled to the input interface 96 (see FIG. 5) of the phase difference detecting device 90. The signal from the cam angle sensor 113 has a waveform identical to that of the signal Q of FIG. 7. Therefore, in the engine $E_1$, the phase difference detecting device 90 is capable of detecting the phase difference between the crankshaft 10, and the camshaft 55 and the camshaft 56 with high accuracy.

The method of detecting the phase difference in the engine $E_1$ is identical to that described with reference to FIGS. 5 to 7, and will not be further described. In addition, the other configuration and components (not shown) of the engine $E_1$ are identical to those of the engine E of FIG. 3, and will not be further described.

While the engine E and the engine $E_1$ are each configured to include the crank sprocket 50, the cam sprocket 57, the cam sprocket 58, and the timing chain 60, they may alternatively be configured to include pulleys and a timing belt.

Figure 10:
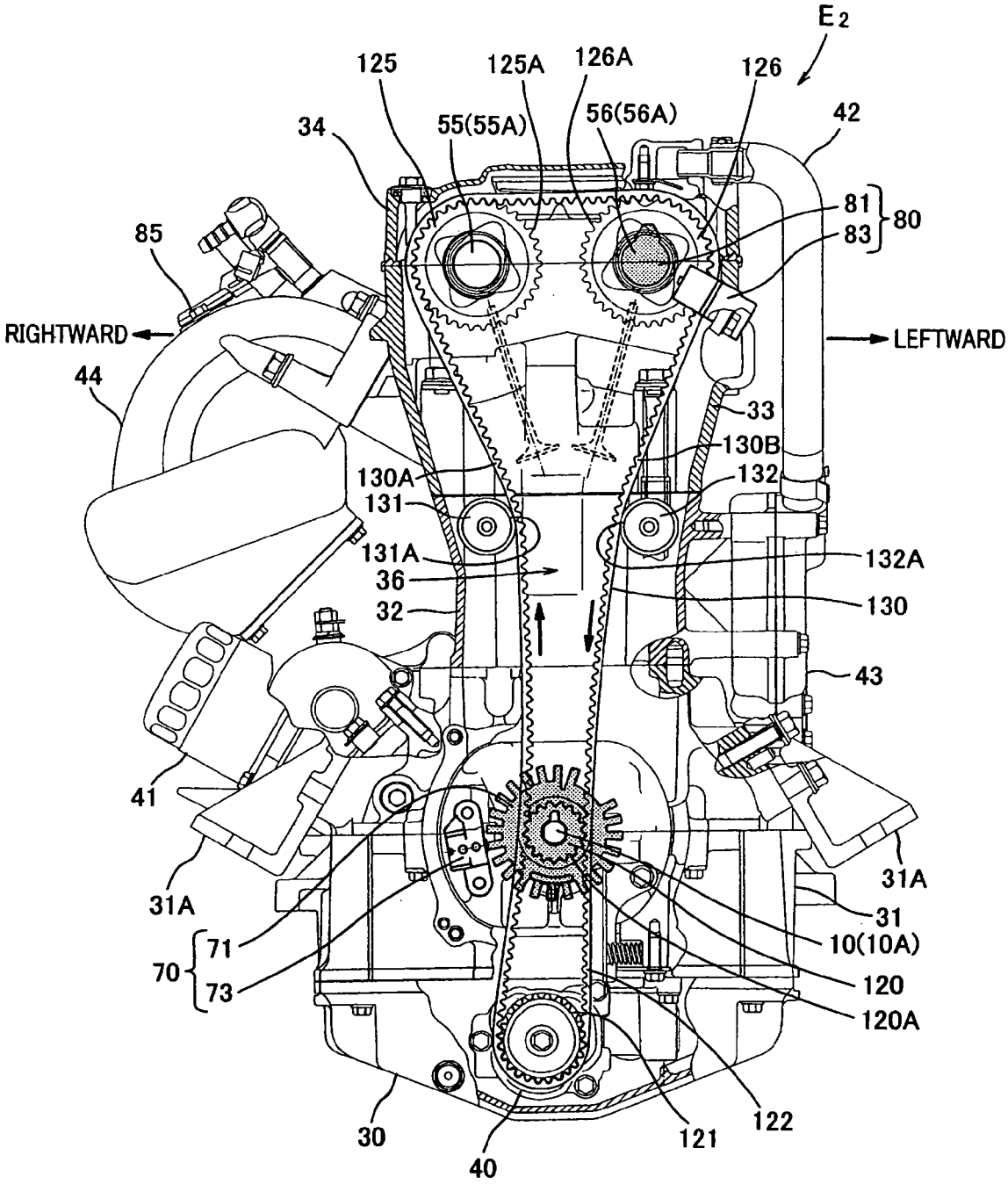
FIG. 10 is a front view of a construction of another engine including pulleys and a timing belt, a part of which is cut away to illustrate a construction of a valve system.

FIG. 10 is a front view of a construction of an engine $E_2$ including the pulleys and the timing belt, a part of which is cut away to illustrate a construction of a valve system. As shown in FIG. 10, two crank pulleys (first gear or toothed pulley) 120 each having a plurality of teeth (17 teeth in this embodiment) 120A are mounted on the front end portion 10A of the crankshaft 10 and are configured to rotate integrally with the crankshaft 10. In FIG. 10, only the outer (front) crank pulley 10 is illustrated. The oil pump 40 equipped in the interior of the oil pan 30 includes a drive pump pulley 121. A drive belt 122 is installed around the inner (rear) crank pulley 120 and the pump pulley 121. The oil pump 40 is driven in cooperation with the rotation of the crankshaft 10.

A cam pulley (second gear or toothed pulley) 125 is mounted on the front end portion 55A of the camshaft 55 and is configured to rotate integrally with the camshaft 55. A cam pulley (second gear or toothed pulley) 126 is mounted on the front end portion 56A of the camshaft 56 and is configured to rotate integrally with the camshaft 56.

The cam pulleys 125 and 126 of this embodiment are of a disc shape and are respectively provided at peripheral regions thereof with teeth 125A and teeth 126A. Each of cam pulleys 125 and 126 are provided with 34 teeth, twice as many as the 17 teeth of the crank pulley 120. The teeth 125A and the teeth 126A are arranged at equal intervals in the circumferential direction thereof so as to protrude radially outward. A timing belt (endless rotation transmission or toothed belt) 130 is installed around the outer (front) crank pulley 120, the cam pulley 125 and the cam pulley 126 in mesh with the teeth 120A, 125A, and 126A. In this construction, the rotation of the crankshaft 10 is transmitted through the timing belt 130, causing the camshafts 55 and 56 to rotate. In the engine $E_2$ of this embodiment, the crankshaft 10 rotates clockwise, causing the timing belt 130 and the camshafts 55 and 56 to rotate clockwise.

Two tension idler pulleys (hereinafter referred to as tensioners) 131 and 132 are rotatably mounted to a front portion of the cylinder block 32 in the interior of the chain tunnel 36. The tensioners 131 and 132 are disposed so that their center axes are oriented in the longitudinal direction of the crankshaft 10.

A peripheral portion 131A of the right tensioner 131 is configured to contact, from rightward, a portion 130A of the timing belt 130 movable between the crank pulley 120 and the cam pulley 125, thereby pressing the portion 130A toward a center of the engine $E_2$ in the rightward and leftward direction. A peripheral portion 132A of the left tensioner 132 is configured to contact, from leftward, a portion 130B of the timing belt 130 movable between the crank pulley 120 and the cam pulley 126, thereby pressing the portion 130B toward the center of the engine $E_2$ in the rightward and leftward direction. The tensioners 131 and 132 apply a suitable tension to the timing belt 130.

As in the engine E of FIG. 3, the engine $E_2$ is equipped with the crank phase detecting device 70 including the pulser rotor 71 and the crank angle sensor 73, the cam phase detecting device 80 including the rotor 81 and the cam angle sensor 83, and the cam phase detecting device including the air-intake pressure sensor 85. The configuration of these components is identical to that of the engine E of FIG. 3, and therefore will not be further described.

In the engine $E_2$ thus constructed, the cam pulley 125 and the cam pulley 126 respectively have 34 teeth, and the pulser rotor 71 mounted on the crankshaft 10 has 22 protrusions at a pitch angle of 15 degrees. In such a configuration, the phase difference detecting device 90 may detect the phase difference corresponding to one tooth 125A of the cam pulley 125 and one tooth 126A of the cam pulley 126.

The system 100 is able to detect the phase difference corresponding to one tooth 125A or 126A with high accuracy so long as the crank phase detecting device 70 is capable of detecting a rotational phase of the crankshaft 10 that is obtained by dividing the phase corresponding to one rotation (360 degrees) of the crankshaft 10 by a number that is equal to or more than a half of the teeth of the cam pulley 125 or the cam pulley 126. In other words, it is necessary that the pitch angle of the protrusions 72 of the pulser rotor 71 be equal to or less than twice as large as the pitch angle of the teeth 125A of the cam pulley 125 or the teeth 126A of the cam pulley 126.

In the configuration for transmitting the rotation from the crankshaft 10 to the camshafts 55 and 56, an idler sprocket or an idler pulley may be mounted to relay the rotation. The present invention is applicable to the single overhead camshaft (SOHC) type engine as well as the DOHC type engine.

While the engines E, $E_1$, and $E_2$ mounted in the personal watercraft have been described in this embodiment, the present invention is applicable to engines for other purposes, such as engines mounted in motorcycles, small four-wheeled automobiles or generators.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A four-cycle engine comprising:

a crankshaft provided with a first gear;

a camshaft provided with a second gear, wherein the second gear has twice as many teeth as the first gear, such that a pitch angle of each tooth of the second gear is half as large as a pitch angle of each tooth of the first gear;

an endless rotation transmission that is installed around the first and second gears and is configured to transmit rotation of the crankshaft to the camshaft;

a crank phase detecting device configured to detect a rotational phase of the crankshaft to a degree that is equal to or less than the pitch angle of the tooth of the first gear;

a cam phase detecting device configured to detect at least one rotational phase of the camshaft; and a phase difference detecting device configured to detect a phase difference between the first gear and second gear to a degree corresponding to one tooth of the second gear, based on input from the crank phase detecting device and the cam phase detecting device.

2. The four-cycle engine according to claim 1, wherein the crank phase detecting device includes a pulser rotor provided at a peripheral region thereof with a plurality of protrusions arranged in a circumferential direction thereof and a crank angle sensor configured to detect the protrusions; and wherein the protrusions of the pulser rotor are arranged at a predetermined pitch angle that is equal to or less than a pitch angle of the teeth of the first gear of the crankshaft.

3. The four-cycle engine according to claim 2, wherein two adjacent protrusions of the plurality of protrusions of the pulser rotor are spaced apart from each other to have a pitch angle that is equal to or more than twice as large as the predetermined pitch angle.

4. The four-cycle engine according to claim 1, wherein the cam phase detecting device includes a rotor having at least one protrusion at a peripheral region thereof and a cam angle sensor configured to detect the protrusion of the rotor.

5. The four-cycle engine according to claim 1, wherein the cam phase detecting device includes an air-intake pressure sensor configured to detect an air-intake pressure of the engine.

6. The four-cycle engine according to claim 1, wherein the camshaft includes a first camshaft configured to drive an intake valve and a second camshaft configured to drive an exhaust valve; and wherein the cam phase detecting device includes a first cam phase detecting device configured to detect at least one rotational phase of the first camshaft and a second cam phase detecting device configured to detect at least one rotational phase of the second camshaft.

7. The four-cycle engine according to claim 6, wherein the first cam phase detecting device and the second cam phase detecting device are each configured to include a rotor having at least one protrusion at a peripheral region thereof and a cam angle sensor configured to detect the protrusion of the rotor.

8. The four-cycle engine according to claim 6, wherein the first cam phase detecting device includes an air-intake pressure sensor configured to detect an air-intake pressure of the engine; and wherein the second cam phase detecting device includes a rotor having at least one protrusion at a peripheral region thereof and a cam angle sensor configured to detect the protrusion of the rotor.

9. The four-cycle engine according to claim 1, wherein the first and second gears include sprockets and the endless rotation transmission includes a chain.

10. The four-cycle engine according to claim 1, wherein the first and second gears include toothed pulleys and the endless rotation transmission includes a toothed belt.

11. A system for detecting a phase difference in a four-cycle engine, comprising:

a four-cycle engine including:

a crankshaft provided with a first gear;

a camshaft provided with a second gear, wherein the second gear has twice as many teeth as the first gear, such that a pitch angle of each tooth of the second gear is half as large as a pitch angle of each tooth of the first gear;

an endless rotation transmission that is installed around the first and second gears and is configured to transmit rotation of the crankshaft to the camshaft;

a crank phase detecting device configured to detect a rotational phase of the crankshaft to a degree that is equal to or less than the pitch angle of the tooth of the first gear;

a cam phase detecting device configured to detect at least one rotational phase of the camshaft; and a phase difference detecting device configured to detect a phase difference between the crankshaft and camshaft based on a signal received from the crank phase detecting device and a signal received from the cam phase detecting device, to a degree corresponding to one tooth of the second gear of the camshaft.

12. The system according to claim 11, wherein the phase difference detecting device is configured to compare a phase of the camshaft that is predetermined with respect to the signal from the crank phase detecting device to a phase of the camshaft that is indicated by the signal from the cam phase detecting device to thereby detect the phase difference of the camshaft with respect to the crankshaft.

13. The system according to claim 12, wherein the phase difference detecting device includes a display configured to display the phase difference of the camshaft in a form of a numeric value of advanced or retarded teeth of the second gear of the camshaft.

* * * * *